United States Patent [19]

Sproul et al.

[11] 4,023,250

[45] May 17, 1977

[54] METHOD AND APPARATUS FOR MAKING HUBLESS V-GROOVED PULLEY AND PRODUCT

[75] Inventors: Nolte V. Sproul, Canton; Michael F. Kark, North Canton, both of Ohio

[73] Assignee: Aspro, Incorporated, Westport, Conn.

[22] Filed: Aug. 4, 1975

[21] Appl. No.: 601,458

[52] U.S. Cl. ..... 29/159 R; 72/83; 72/84; 74/230.8

[51] Int. Cl.[2] ..... B21D 53/26; B21K 1/28; B21D 22/14; B21D 22/00

[58] Field of Search ..... 74/230.8; 29/159 R; 72/83, 84

[56] References Cited

UNITED STATES PATENTS

| | | | |
|---|---|---|---|
| 2,493,053 | 1/1950 | Zatyko | 74/230.8 UX |
| 2,929,345 | 3/1960 | Zatyko, Sr. | 74/230.8 X |
| 3,851,366 | 12/1974 | Jacobs | 74/230.8 X |
| 3,852,863 | 12/1974 | Killian et al. | 29/159 R |

*Primary Examiner*—Leonard H. Gerin
*Attorney, Agent, or Firm*—Frease & Bishop

[57] ABSTRACT

A one-piece tubular walled spun sheet metal pulley having a V-shaped pulley groove formed by a single V-groove wall and a partial double fold V-groove wall. An integral tubular pulley mounting flange wall extends axially from the double flange wall located intermediate the crests and valley of the V-groove forming walls in cross section.

The tubular spun sheet metal V-grooved pulley product is made by drawing from a sheet blank a cup-shaped stage blank having a bottom wall, and a primary cylindrical flange wall connected by an offsetting shoulder with an enlarged secondary cylindrical flange wall terminating in an open end; then knocking out the bottom wall of the cup-shaped stage blank to form a tubular stage blank having offset primary and secondary cylindrical flange walls; and then spinning a V-shaped pulley groove in the secondary flange wall of the tubular blank which groove in cross section has a single V-groove wall and a partial double fold V-groove wall connected with the primary cylindrical flange wall intermediate the crests and valley of the V-groove forming walls.

The apparatus for spinning a V-groove in the hubless offset cylindrical stage blank includes means for supporting the stage blank on its open ends at spaced locations on relatively axially movable headstock and tailstock die means assemblies; means for internally and externally telescopically supporting a stage blank primary cylindrical flange wall in tailstock die means during relative axial movement between the headstock and tailstock die means and while spinning a V-groove in the enlarged stage blank secondary cylindrical flange wall; and internally supporting the pulley V-groove walls on headstock and tailstock die means as the V-groove is being spun.

14 Claims, 10 Drawing Figures

METHOD AND APPARATUS FOR MAKING HUBLESS V-GROOVED PULLEY AND PRODUCT

BACKGROUND OF THE INVENTION

1. Field of the Invention

The invention relates to a one-piece hubless-type V-grooved pulley formed from an offset cylindrical tubular sheet metal blank having a cylindrical pulley mounting flange extending from the V-grooved portion of the pulley, in which the mounting flange may mount the pulley, for example, on the clutch of an automotive air compressor to provide V-belt drive means for the air compressor. More particularly, the invention relates to a special cross-sectional contour of the V-shaped tubular pulley product and to methods of and apparatus for the manufacture of such pulleys.

2. Description of the Prior Art

Extensive use of automotive air conditioner equipment has called for improvements in the V-belt pulley drive structure mounted on the air conditioner compressor clutch. It is desirable to assemble the pulleys telescopically with tubular pulley flange means telescopically mounted on a compressor clutch. This has required the hub bottom wall of prior cup-shaped pulleys to be removed. However, such expedient heretofore in some instances has limited the location of the V-groove in a spun one-piece pulley to be entirely outside the tubular pulley mounting flange.

Such arrangements require the use of more metal, and thus, a heavier weight of pulley than is desirable. Also pulleys formed by a series of die press operations have involved a double flange V-groove wall at the open end of the pulley.

A need exists for spun dynamically-balanced pulleys used for driving automotive air conditioners and adapted for telescopic mounting on the compressor clutch which spun pulleys have great strength, dynamic balance and reduced metal content and weight as compared with prior pulleys; and for a method of and apparatus for manufacturing such pulleys.

SUMMARY OF THE INVENTION

Objectives of the invention include providing a new one-piece, tubular-walled, hubless, spun, V-grooved, dynamically-balanced, sheet steel pulley having a single thickness V-groove wall and a partial double fold V-groove wall, and having a tubular mounting flange extending in cross section integrally axially from the double fold intermediate the crests and valley of the V-groove forming walls; providing new methods and procedures for the manufacture of such a dynamically-balanced hubless, spun, V-grooved, sheet steel pulley; providing a new procedure for the manufacture of such pulley structure in which a tubular stage blank having offset primary and enlarged diameter secondary cylindrical walls has its primary cylindrical wall internally and externally telescopically supported, held, piloted and centered by spinning dies while a pulley V-groove is roller spun in the tubular secondary cylindrical wall, while internally supporting the V-groove forming walls as the V-groove is being spun, also while the length of the offset tubular blank is shortened, and also while the open end of the secondary cylindrical wall is radially confined against outward expansion; providing new apparatus for spinning a V-groove in a tubular stage blank having offset primary and enlarged diameter secondary cylindrical walls; providing such new pulley structures, and methods and apparatus for making the same which eliminate difficulties heretofore encountered, achieve the various objectives indicated in a practical and easily performed manner, and which solve problems and satisfy needs existing in the art; and providing new pulleys, methods and apparatus comprising improvements upon those shown in U.S. Pat. Nos. 2,685,856, 2,826,804, 2,869,223, 2,892,431 and 3,852,863.

These and other objectives and advantages are obtained by the pulley structure, the general nature of which may be stated as including in a dynamically-balanced, one-piece, hubless, V-grooved sheet steel pulley, a V-groove formed by single and partial double fold V-groove walls, and a cylindrical mounting flange wall extending in cross section integrally axially from the double flange wall intermediate the crests and valley of the V-groove walls; by the methods of making such pulleys, the general nature of which may be stated as including drawing a cup-shaped sheet steel stage blank having a bottom wall and primary and secondary offset cylindrical side walls terminating in an open end, knocking out the bottom wall to form a tubular stage blank having offset primary and secondary cylindrical walls, then rough and finish roller spinning a V-groove in the secondary flange wall of the tubular stage blank, and locating the primary cylindrical wall radially intermediate the crests and valley of the V-groove forming walls; and by roller spinning apparatus, the general nature of which may be stated as including rotary spinner relatively axially movable headstock and tailstock die assemblies having headstock and tailstock spin die forms, the tailstock die form including means for internally and externally telescopically supporting a stage blank primary cylindrical flange wall during relative axial movement between the headstock and tailstock die assemblies, rough and finish spin roller means movable radially relative to the spin die forms while rotating and while holding a tubular stage blank therebetween, and the die forms including means for internally supporting the pulley V-groove walls as a V-groove is being roller spun in the tubular stage blank secondary cylindrical flange wall.

BRIEF DESCRIPTION OF THE DRAWINGS

Preferred embodiments of the new hubless-type V-groove pulley structure invention, and of a method of and apparatus for the manufacture of such pulley—illustrative of the best modes in which applicants have contemplated applying the principles —are set forth in the following description and shown in the drawings and are particularly and distinctly pointed out and set forth in the appended claims.

Similar numerals refer to similar parts throughout the various figures of the drawings.

DESCRIPTION OF THE PREFERRED EMBODIMENT

Pulley Structure

Figure 5:
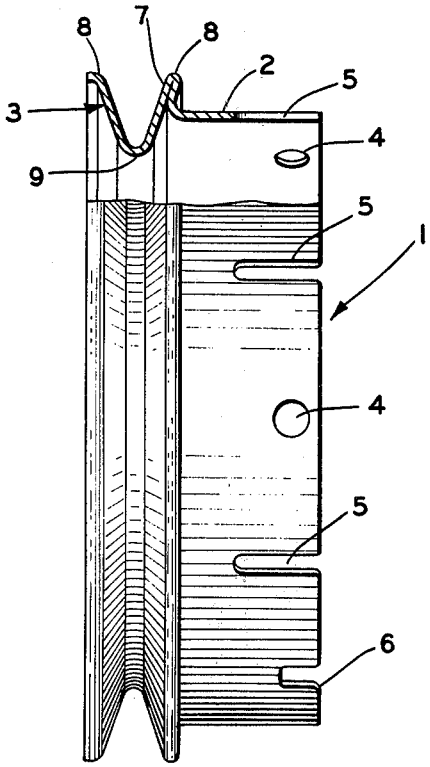
FIG. 5 is a view similar to FIG. 4 of the pulley after the rough-formed V-groove of FIG. 4 has been subjected to a final or finish roller V-groove spinning operation, and also showing a finished pulley having apertures and slots formed in its smaller diameter cylindrical flange wall following the spinning operations.

The new pulley structure concept of the invention is best shown in FIG. 5. The interrelated new method of making the new hubless-type V-groove pulley of the invention is shown somewhat diagrammatically by the stage blanks of FIGS. 1 to 5, and by the steps shown in FIGS. 6 through 10. The new spinning apparatus of the invention and its interrelated features by which certain steps of the improved method may be carried out to form the new pulley structure is shown in FIGS. 7 through 10.

Pulleys embodying the invention may have specified dimensional characteristics as to length and diameter of mounting flange and as to groove diameter to suit the requirements for installation of the pulley for its intended purpose.

The new pulley, generally indicated at 1 in FIG. 5, is a one-piece hubless-type V-grooved pulley having a cylindrical pulley mounting flange 2 extending from the V-grooved portion 3 of the pulley. The mounting flange 2 may mount the pulley 1, for example, on the clutch on an automotive air compressor to provide drive means for the air compressor. The mounting flange 2 may be formed with suitable apertures 4 and slots 5 and 6 for mounting the pulley on the air compressor clutch.

In accordance with the invention, the pulley has a special configuration in cross section in which the mounting flange 2 which is integral with the V-grooved portion 3, extends axially from the double fold flange wall portion 7 of the groove-forming walls 3. The mounting flange 2 is located in cross section intermediate the crests 8 and valley 9 of the V-groove forming walls.

The relative location and diameter of the pulley mounting flange 2 with respect to the location of the V-groove walls 3 and the inner diameter of the groove valley 9, as well as the omission of a pulley hub bottom wall, reduces the amount of metal in and the weight of the pulley. Both of these characteristics are desirable. Further, the pulley 1 in having a roller spun V-groove 3 formed therein, is dynamically balanced which, together with its decreased weight, provides a very desirable sheet metal, preferably sheet steel, pulley structure for a V-belt drive of an automotive air conditioner compressor clutch.

Furthermore, the improved pulley structure in having one of the groove-forming walls formed of a single metal thickness, and in having only a portion of the other V-groove forming wall composed of a double fold, eliminates excess metal heretofore present in pulleys of the general type shown that have been formed by a series of die press operations. Prior press-formed pulleys of this general type have been characterized by a weight and metal increasing double flange V-groove wall at the open end of the pulley.

Method of Making Hubless-Type V-Grooved Pulley

Figure 1:
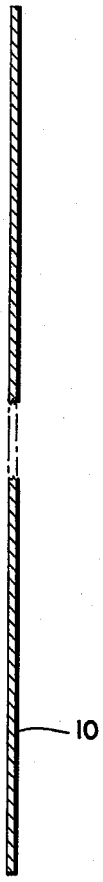
FIG. 1 is a somewhat diagrammatic sectional view, with parts broken away, of a sheet metal blank from which the new hubless-type V-groove pulley structure may be formed.
Figure 2:
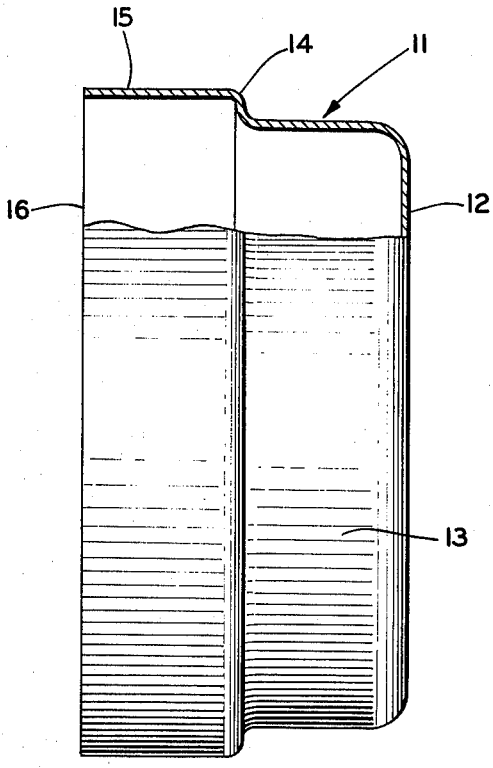
FIG. 2 is a side elevation, with parts broken away and in section, of a cup-shaped blank drawn from the sheet blank of FIG. 1, comprising the first stage blank in the manufacture of the new pulley structure.
Figure 6:
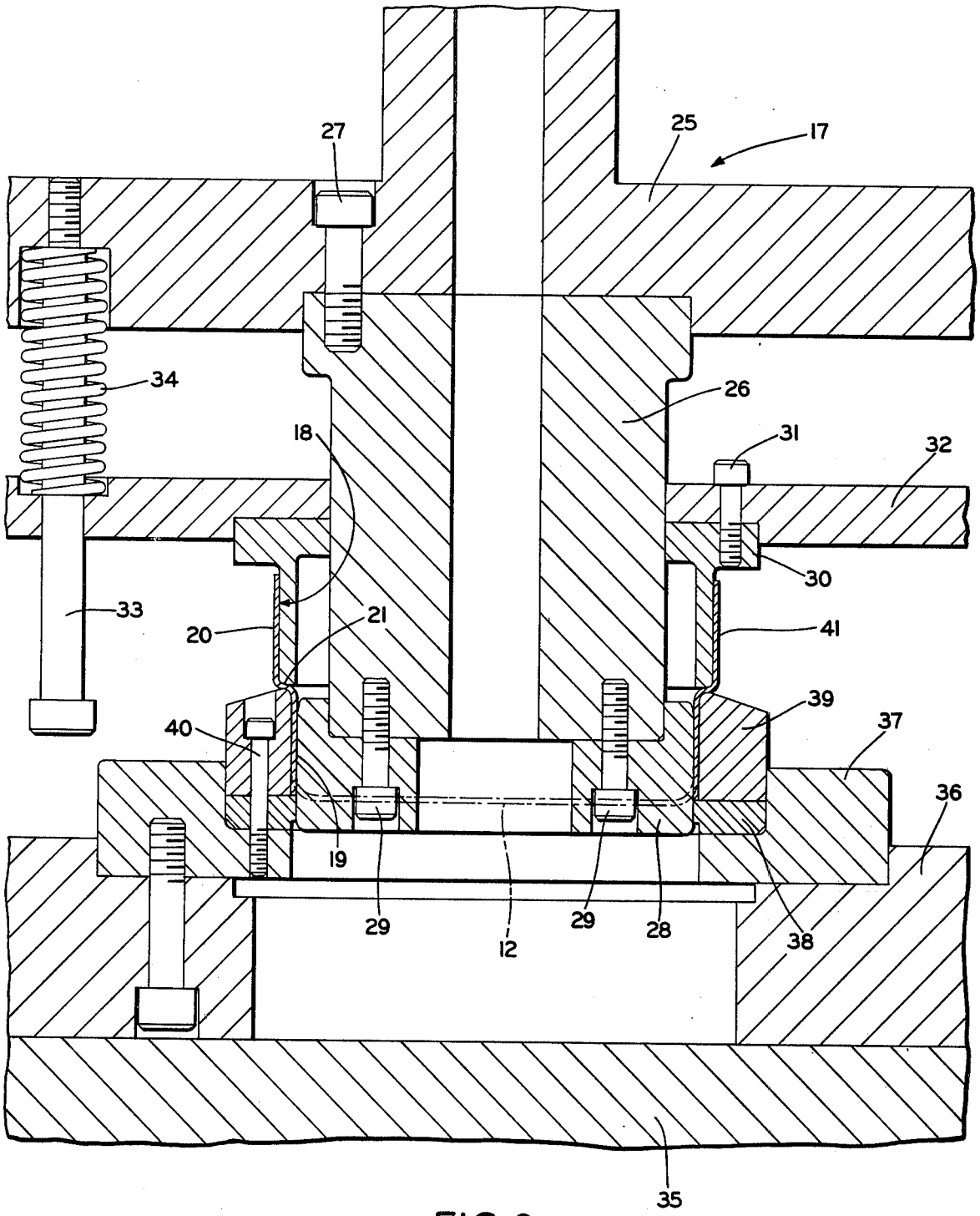
FIG. 6 is a somewhat diagrammatic sectional view through a press and dies used to pierce out the bottom wall of the stage blank of FIG. 2 to form the tubular stage blank of FIG. 3.
Figure 7:
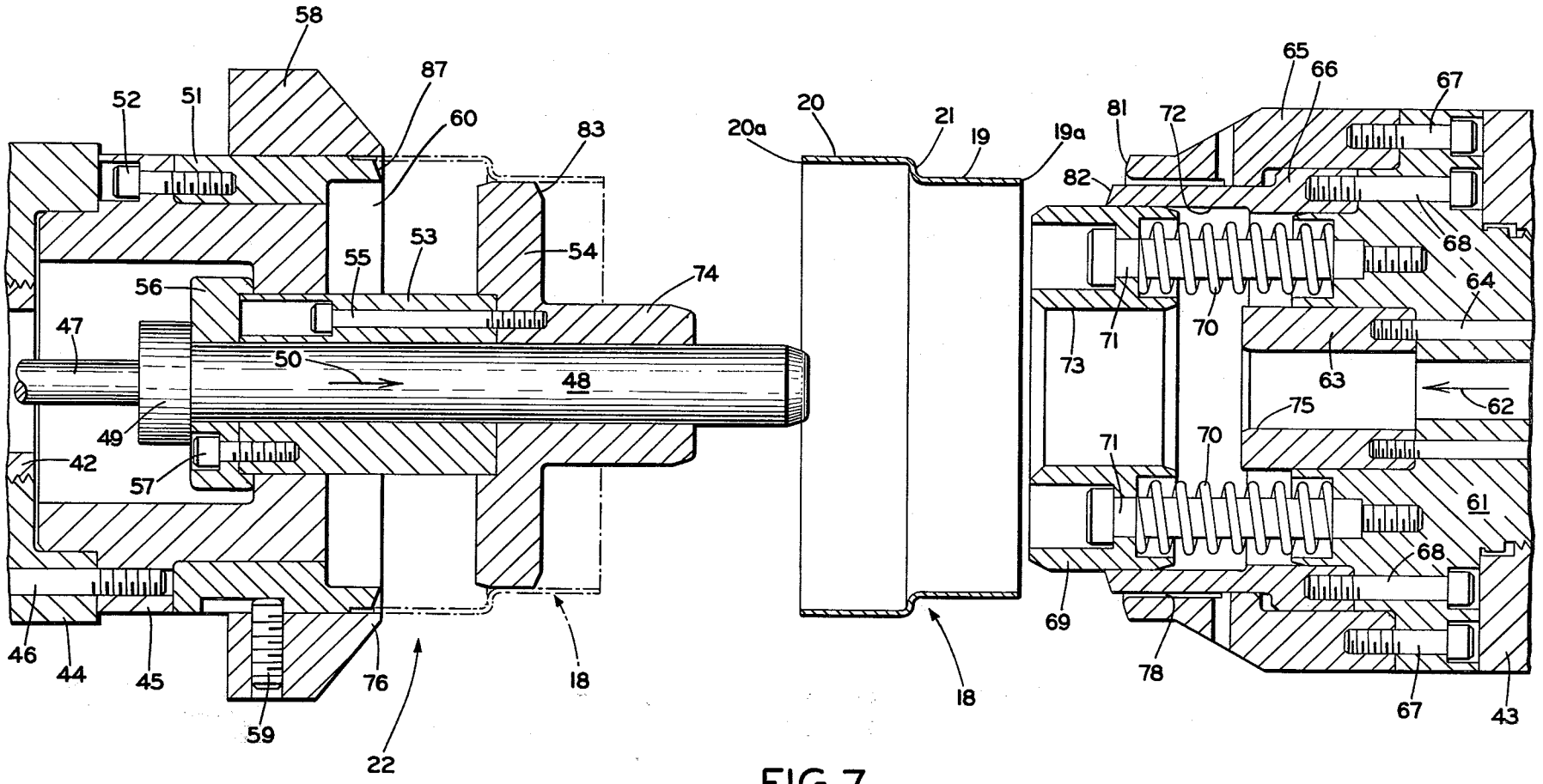
FIG. 7 is a fragmentary diagrammatic sectional view illustrating spinning dies, including separated rotary headstock and tailstock die assemblies separated, with the tubular blank of FIG. 3 inserted therebetween ready to be loaded on the dies in preparation for spinning a V-groove in the enlarged secondary cylindrical flange wall of the tubular blank.
Figure 9:
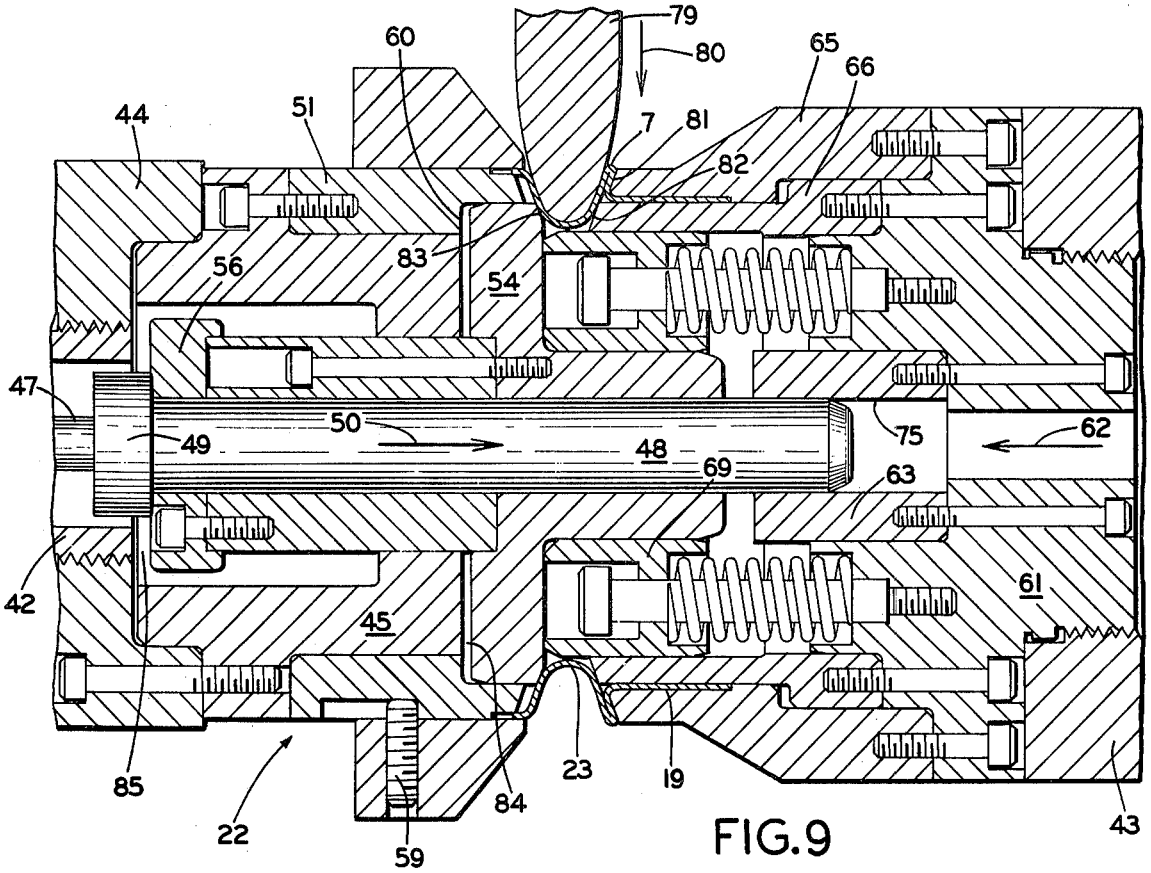
FIG. 9 is a view similar to FIGS. 7 and 8 showing the completion of a rough roller spinning of a V-groove in the enlarged secondary cylindrical flange wall of the tubular stage blank, with the roughing roller in "home" position.
Figure 10:
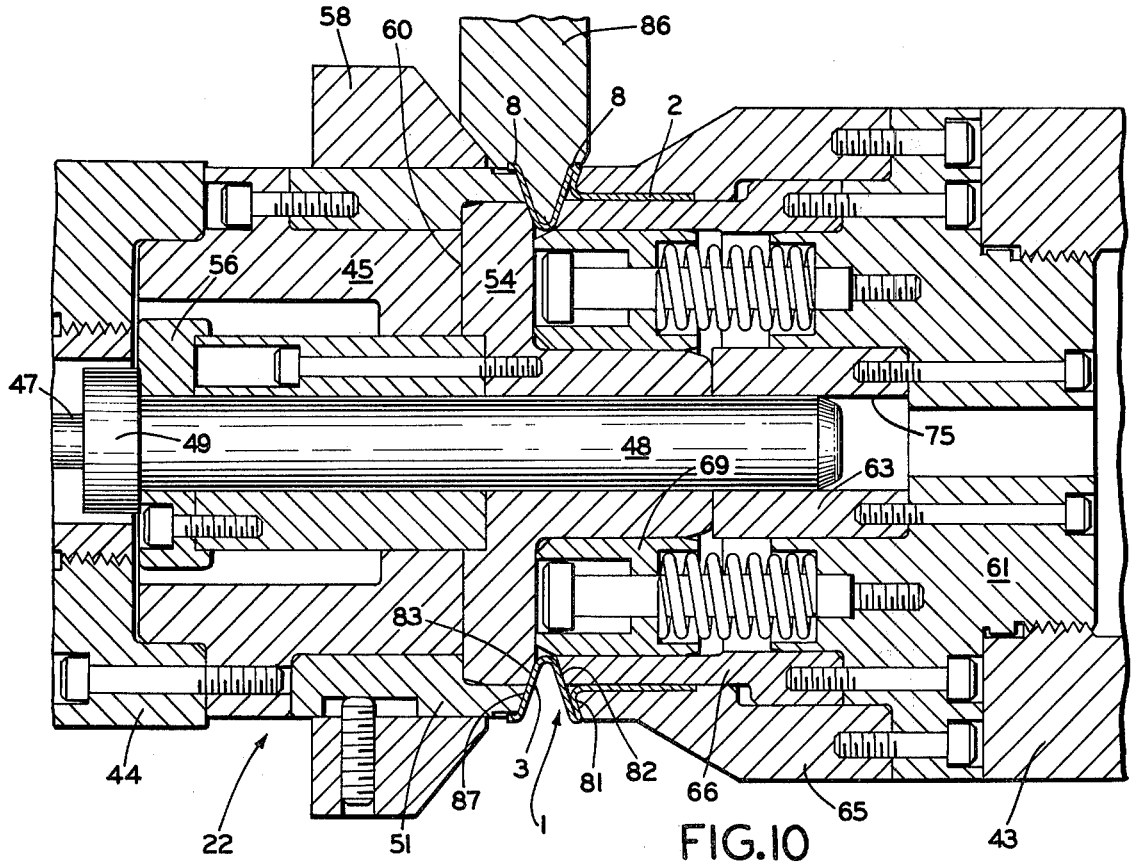
FIG. 10 is a view similar to FIG. 9 showing the completion of the final roller spinning of the pulley V-groove, with the finish spinning roller in "home" position.

The special new procedure for manufacturing pulleys 1, having the combination of characteristics described, is illustrated in FIGS. 1 through 5 and certain steps are shown in FIGS. 6, 9 and 10. A sheet metal blank 10, preferably sheet steel of the desired or required gauge, is deep drawn to form the cup-shaped stage blank 11 (FIG. 2). The blank 11 has a bottom wall 12, a primary cylindrical side or flange wall 13, an offset shoulder 14, and an enlarged secondary cylindrical flange wall 15, terminating in an open end 16.

The bottom wall 12 of stage blank 11 then is knocked out or pierced, for example in a press 17 (FIG. 6), described below to form the tubular stage blank 18 shown in FIG. 3, having offset primary and secondary cylindrical flange walls 19 and 20 joined by the offset shoulder 21.

The tubular stage blank 18 then is processed in a rotary spinner 22 to roller spin the finished V-groove 3 in the finished pulley 1 of FIG. 5. The construction of the rotary spinner 22 is described below and is shown in FIGS. 7 through 10. During rotary spinning, the V-groove 3 is roller formed in the secondary flange 20 of tubular stage blank 18. Preferably during spinning, a rounded rough-formed groove 23 initially is formed in the tubular stage blank 18. The blank in its stage after rough roller spin forming the rounded groove 23 is indicated at 24 in FIG. 4.

After the formation of the rounded groove 23, the final desired V-shape for the groove 3 is roller spun and ironed by finish spin rollers, as described below, to reshape the rounded groove 23 to the desired V-shape 3 as shown in FIG. 5.

Apparatus for Forming A Stepped Tubular Stage Blank and For Spinning A V-Groove in the Tubular Blank The bottom wall 12 of cup blank 11 may be pierced or knocked out in a piercing press 17 diagrammatically shown in FIG. 6. The press 17 has a punch holder 25 mounted on a ram, not shown, to which a punch 26 is bolted at 27, and a punch nose 28 is bolted at 29 to punch 26. An upper die ring 30 is bolted at 31 to floating plate 32 surrounding and relatively axially movable with respect to punch 26. Floating plate 32 is mounted on punch holder 25 by bolts 33 and is spring pressed downward by springs 34.

The press bed 35 has a die shoe 36 mounted thereon supporting the lower die ring holder 37. Lower die piercing and support rings 38 and 39 are bolted at 40 to the lower die holder 37.

Piercing of the cup blank 11 is performed by placing the blank in the lower die support ring 39, with the press 17 open. The blank bottom wall 12 is in the position shown in dot-dash lines in FIG. 6, and the blank primary cylindrical flange wall 13 (FIG. 2) is received within the support ring 39, and the blank offset shoulder 14 (FIG. 2) is supported on the upper end of ring 39.

As the press ram descends, the annular pilot of die ring 30 telescopes internally of the enlarged cylindrical wall 15 of the blank 11 (FIG. 2); and the cup blank thus is securely held in and between die members 30 and 39.

Meanwhile, the punch 26 descends and punch nose 28 pinch trims and shears the bottom wall 12 of the cup blank 11 from the blank between nose 28 and piercing ring 38. During punch trimming, the primary flange wall 13 of blank 11 (FIG. 2) is extruded to the shape shown in full lines in FIG. 6 which comprises the tubular stage blank 18 of FIG. 3.

Rotary spinning apparatus 22 for spinning a pulley V-groove in the tubular stage blank 18 is shown in various positions of its operation in FIGS. 7 to 10. The spinner may be typical equipment having special dies and may be a lathe-type spinner, such as described and illustrated in U.S. Pat. Nos. 2,685,856, 2,826,804, 2,869,223, 2,892,431 and 3,852,863.

The spinner headstock spindle is indicated at 42, and the tailstock spindle at 43. A headstock tool mounting adapter member 44 may be mounted on headstock spindle 42, and the headstock body 45 is bolted at 46 to adapter 44. The headstock mandrel operating shaft 47 extends through members 42, 44 and 45 and has a spin form pilot pin 48 mounted thereon and a stop shoulder 49. The shaft 47 and pilot pin 48 are attached to a usual air cylinder and are under pressure at all times urging the pilot pin 48 toward the tailstock 43 in the direction of the arrow 50.

A headstock face ring 51 is bolted at 52 to the headstock body 45, and an inner sleeve 53 is slidably mounted on pilot pin 48 and within the body 45. A disc-like member 54 is bolted at 55 to the forward end of sleeve 53, and a float-out stop 56 is bolted at 57 to the other end of sleeve 53 within the body 45. A spin ring 58 surrounds and is slidably mounted on face ring 51, and movement thereof is limited by stop screw 59. Ring 58 normally is spring pressed (not shown) to the position shown in FIG. 7 but may yield to the left as later described. During operation, the disc of member 54 moves into the recess 60 formed in body 45 and face ring 51, at which time the member 54 becomes a part of face ring 51 which together with the spin ring 58 comprises the headstock spin form.

A tailstock body 61 is mounted on tailstock spindle 43, and these members are movable in the direction of the tailstock arrow 62. A tailstock bushing 63 is bolted at 64 to the body 61, and tailstock face ring 65 and insert 66 also are bolted at 67 and 68, respectively, to body 61. An annular pressure plate 69, normally urged to the position shown in FIG. 7 by spring 70, is mounted by bolts 71 on tailstock body 61 for telescopic movement into cavity 72 formed in insert 66. As the tailstock 43 moves in the direction of the arrow 62, the bore 73 of pressure plate 69 telescopes over the hub 74 of disc member 54, and the extreme end of pilot pin 48 enters the bore 75 of bushing 63.

Figure 3:
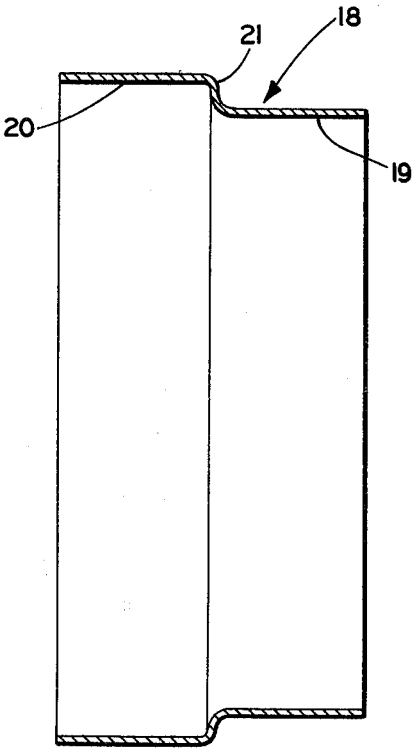
FIG. 3 is a sectional view showing the bottom wall of the stage blank of FIG. 2 pierced out, and the adjacent portion of the cup side wall extruded, to form a tubular stage blank with offset inner primary and outer secondary cylindrical flange walls.
Figure 4:
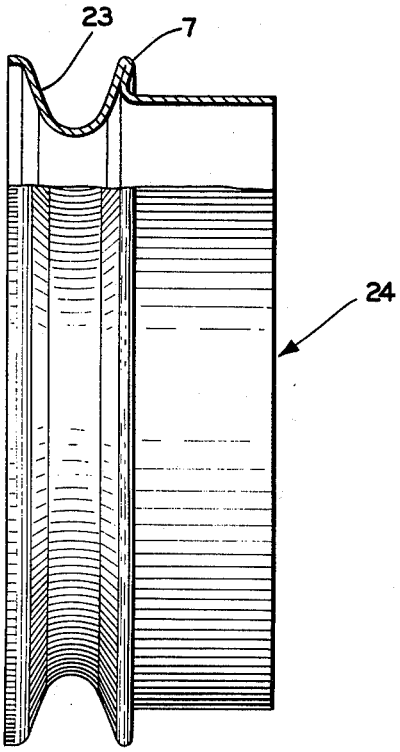
FIG. 4 is a side elevation, with parts broken away and in section showing the tubular stage blank of FIG. 3 after spin roller rough-forming a V-groove in the larger diameter cylindrical flange wall of the offset tubular stage blank.

The operation of spinning a V-groove in the tubular stage blank 18 of FIG. 3 may be carried out by axially separating the headstock and tailstock die assemblies of spinner 22 sufficiently to enter the tubular blank 18 between such die assemblies and to telescope the shoulder 21 and primary flange 19 of the tubular blank 18 over the annular periphery of the disc-like member 54. At this time, the open end edge 20*a* of the secondary flange 20 of tubular blank 18 is engaged within the overhang of the nose portion 76 of spin ring 58, as shown in dot-dash lines in FIG. 7; and as also shown in full lines in FIG. 8, with respect to the position of the blank 18 relative to the spin ring 58.

Figure 8:
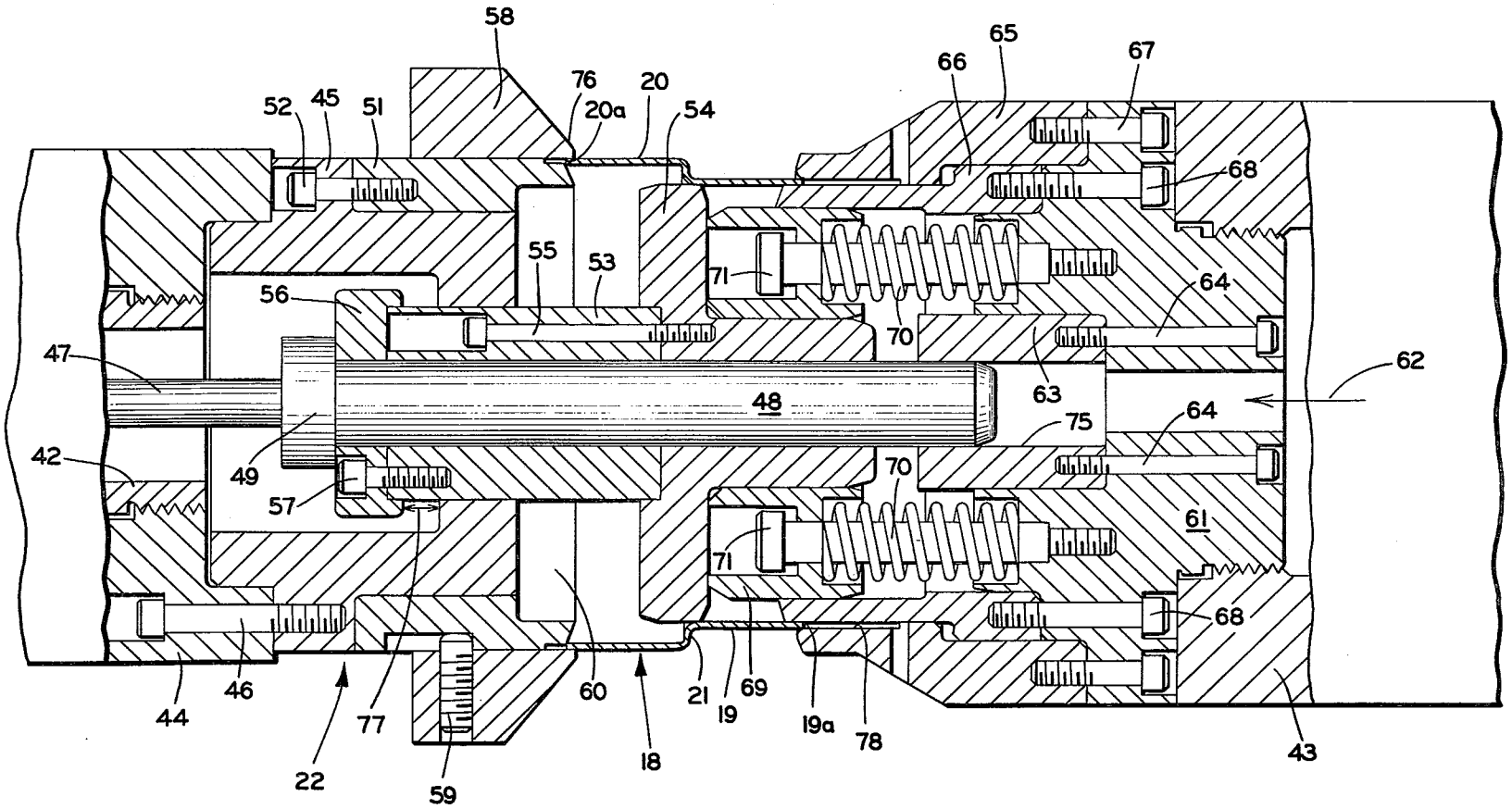
FIG. 8 is a view similar to FIG. 7 showing the tubular blank of FIG. 3 in "load" position and with headstock and tailstock die components piloting and centering the loaded tubular blank, just prior to starting the V-groove roller spinning operation.

Meanwhile, referring to FIG. 8, the tailstock 43 is moved in the direction of the tailstock arrow 62, and the pressure plate 69 engages the disc 54, moving it and sleeve 53 and float-out stop 56 toward the left within the headstock body 45, as indicated by the space 77 between the float-out stop 56 and the headstock body 45, illustrated in FIG. 8.

At the same time, the open end edge 19a of the primary cylindrical flange 19 of the tubular stage blank 18 is piloted over the free end of tailstock insert 66 and starts to enter the slot 78 between the insert 66 and tailstock face ring 65. The position of the parts in FIG. 8 represents the tubular blank in "load" position, with the headstock and tailstock die components piloting and centering the loaded tubular blank 18 and supporting the stage blank 18 on its open ends at spaced locations on the relatively axially movable headstock and tailstock spin die forms.

From the load position of FIG. 8, the tailstock 43 continues to move (FIG. 9) axially in the direction of the arrow 62 toward the headstock against the pressure of the air cylinder (which urges the pilot pin 48 normally in the direction of the arrow 50) so that the pilot pin 48 moves in the other direction or toward the left to the position shown in FIG. 9. At this time, the disc member 54 is telescoped within the recess 60 of face ring 51.

During the relative axial movement of the tailstock 43 toward the headstock 42, a rough groove spinning roller 79 is fed radially toward the spinner axis, as indicated by the arrow 80 to roller spin a rounded groove in the secondary enlarged flange wall 20 of the tubular stage blank 18. During the relative movement of the headstock and tailstock die assemblies toward each other and the action of the rough spinning roller 79, the tapered nose 81 of tailstock face ring 65 forms the pulley groove partial double fold flange 7 between the nose 81 and roughing roller 79.

Also, the tapered nose 82 of tailstock insert 66 and the tapered face 83 of disc 54 internally support and assist in forming the rounded rough formed groove 23 in cooperation with the action of the roughing spinning roller 79, as shown in FIG. 9.

Meanwhile, the primary flange 19 of the blank 18 is telescoped into the slot 78 and is internally and externally telescopically supported in the tailstock die during the relative axial movement between the headstock and tailstock dies and during the rough spinning of the groove.

At the completion of the rough spinning operation, there still is a space 84 between the disc member 54 and the headstock body 45, and there also is a space 85 between the float-out stop 56 and the headstock spindle 42, which will permit further subsequent movement of the tailstock die means toward the headstock die means during the final stage of finish spinning the pulley groove. FIG. 9 shows the parts at the conclusion of the rough spinning portion of the groove spinning operation.

At this time, the roughing spinning roller 79 is radially retracted, and a finish spinning roller 86 (FIG. 10) is moved radially toward the rotary axis of the spinner to complete and iron the V-shape of the groove. At the conclusion of finish spinning, the disc member 54 is completely entered in the recess 60, and the tapered face 83 of member 54 forms a continuation of the tapered end 87 of the headstock face ring 51; so that the single thickness wall of the V-groove is ironed in straight or flatwise cross sectional shape between one side of the finish spinning roller 86 and the faces 83 and 87. At the same time, the noses 81 and 82 of tailstock face ring 65 and insert 66 iron the straight cross-sectional shape of the partial double fold and the remaining single thickness groove forming wall of the V-groove against the complementary surface of the finish spinning roll 86, as shown in FIG. 10.

During the finish spinning operation, shown in FIG. 10, the faces 82, 83 and 87 internally support the pulley V-groove walls as the V-groove formation is being finished.

The cooperative relation between the spin form elements of the headstock and tailstock dies permits the partial double fold to be formed with the mounting flange 2 of the finished pulley 1 located radially intermediate the crests and valley of the V-groove 3 and at the same time the spin forms provide internal support for the sheet metal as it is being worked and spun. In addition, this relation permits separation of the headstock and tailstock spin forms at the completion of the spinning operation without the necessity of providing retractable inner supporting die means.

As shown in FIG. 10, as the finish spinning roller 86 reaches "home" position, it engages the spin ring 58 which moves toward the left and permits the crests 8 of the V-formation to be ironed by the roller 86.

IN GENERAL

The various cooperative relationships and interrelated features of the new partial double fold V-grooved pulley having a cylindrical mounting flange extending axially from the double fold intermediate the crests and valley of the V-groove, and the method of manufacturing such a pulley, as well as the particular roller spinning apparatus in which such manufacture may be carried out to produce such a pulley, which comprise the various facets of the described inventions, enable the production of the new pulley structure with reduced weight and metal content as compared with prior pulleys.

Fundamental facets of the new concepts involve the manner and shape in which the offset tubular sheet metal stage blank is formed; the manner in which portions of such stage blank are held and cold worked as the V-groove is being formed; and the construction of the spin forms on which the offset tubular stage blank is worked, to provide the particular one-piece, hubless-type, dynamically-balanced, sheet metal, V-grooved pulley.

Accordingly, the present invention provides substantial improvements, not only in V-groove pulley products, but also in the art of making dynamically-balanced, roller spun V-groove pulleys; provides for the manufacture of dynamically-balanced pulleys of minimum weight formed in one piece with a V-shaped pulley groove and having an integral tubular mounting flange which extends axially of the pulley intermediate the crests and valley of the V-groove; and provides products, methods and apparatus which achieve the stated objectives, eliminate difficulties existing in the art, and solve problems and satisfy existing needs, and obtain the new results indicated.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries, and principles of the invention, the particular new combination of structural features of the new pulley, the related procedural steps by which the new pulley may be manufactured, the construction and operation of the improved roller spinning apparatus, the details of the steps of the improved method, and the advantageous, new and useful results obtained; the new and useful structures, devices, elements, arrangements, parts, combinations, subcombinations, procedures, methods, method steps and apparatus are set forth in the appended claims.

We claim:

1. In a method of making a one-piece, dynamically-balanced, spun, sheet metal pulley formed with a V-groove having a valley and crests, the steps of drawing a cup-shaped sheet metal stage blank having a bottom wall and offset primary and enlarged secondary cylindrical side walls; removing the stage blank bottom wall to form a tubular stage blank having offset primary and enlarged secondary cylindrical walls; then roller spinning a V-shaped groove in the secondary tubular stage blank wall; and locating the primary tubular stage blank wall radially intermediate the location of the valley and crests of the spun V-groove, while spinning the V-groove.

2. The method set forth in claim 1 in which the removal of the stage blank bottom wall is carried out by pinch trim shearing the bottom wall from the cup-shaped stage blank; and in which the stage blank primary cylindrical side wall is extruded during pinch trim shearing to produce the tubular stage blank primary cylindrical wall.

3. In a method of making a one-piece, dynamically-balanced, spun, sheet metal pulley formed with a V-groove having a valley and crests, the steps of providing a tubular sheet metal blank with offset inner and outer cylindrical wall portions; then roller spinning a V-shaped groove in the outer wall portion; and locating the inner cylindrical wall portion radially intermediate the location of the valley and crests of the spun V-groove, while spinning the V-groove.

4. The method set forth in claim 3 in which the open ends of the inner and outer tubular blank wall portions are supported at spaced locations and moved axially toward each other during roller spinning of the V-shaped groove; in which the inner cylindrical tubular blank wall portion is supported internally and externally during said axial movement; and in which the outer cylindrical tubular blank wall portion being formed with a V-groove is internally supported as the V-groove is being roller spun therein.

5. The method set forth in claim 4 in which the open end of the outer cylindrical tubular blank wall portion is radially confined against outward expansion as the V-groove is being roller spun in said outer cylindrical tubular blank wall portion.

6. The method set forth in claim 5 in which the tubular blank is provided with an offset shoulder between the inner and outer cylindrical wall portions; in which the roller spinning of the V-groove is carried out by initially rough roller spinning a rounded groove, and by then finish spinning the rounded groove to V-groove shape; and in which the tubular blank offset shoulder is reformed into a partial double fold connecting the V-groove walls with the inner cylindrical tubular blank wall portion as the V-groove is being roller spun.

7. A rotary spinning apparatus for spinning a V-groove in a hubless, tubular, sheet metal blank formed with offset inner and outer cylindrical walls having spaced open ends, including rotatably, relatively axially movable headstock and tailstock die means; the die means including means for supporting the spaced open, inner and outer tubular blank cylindrical wall ends for rotating the blank during and by rotation of the die means and during relative axial movement of the headstock and tailstock die means toward each other; annular disc means mounted on the headstock die means and axially movable with respect to the headstock die means and engageable with the interior of the tubular blank intermediate the spaced open ends for pilot centering and internally supporting said blank as end support engagement of the blank is being established; the tailstock die means being formed with slot means, with said slot means internally and externally telescopically confining the inner tubular blank cylindrical wall end during said rotation and relative axial movement; spinning roller means radially movable toward said headstock and tailstock die means during said rotation and relative axial movement of the die means for cooperation with the die means for spinning a V-groove in the outer tubular blank cylindrical wall; pressure plate means mounted on the tailstock die means and axially movable with respect to said tailstock die means for engagement with the annular disc means for moving said disc means toward the headstock die means during spinning of the V-groove; the headstock and tailstock die means and the disc means including annular tapered surfaces internally supporting the V-groove walls as the V-groove is being spun in the outer cylindrical wall during the rotation and relative axial movement of the headstock and tailstock die means.

8. The construction defined in claim 7 including means carried by the headstock die means radially confining the end of the outer tubular blank cylindrical wall against outward expansion as the V-groove is being roller spun in said outer wall.

9. The construction defined in claim 7 in which rounded rough spinning roller means and V-shaped finish spinning roller means successively engage blank metal against the headstock and tailstock die means for roller spinning the V-shaped groove in said outer blank wall.

10. The construction defined in claim 7 in which the tailstock die means annular tapered surfaces include spaced tapered annular noses engaging the blank internally and externally of the inner tubular blank cylindrical wall; and in which said noses cooperate with the spinning roll means to form one of the V-groove walls as the V-groove is being spun.

11. The construction defined in claim 7 in which the headstock die means includes a face ring having a recess formed therein into which the support disc means is moved by the pressure plate means of the tailstock die means upon relative movement between the tailstock and headstock die means toward each other; and in which the face ring has a cooperating annular tapered face, which when the disc is moved into the recess, supports one of the V-walls of the V-groove as the V-groove is being roller spun in the outer blank wall.

12. The construction defined in claim 7 in which a bushing having an axially extending bore is mounted on the tailstock die means; in which the pressure plate means has an axially extending bore and is normally biased toward the headstock die means; in which a headstock pilot pin is yieldingly urged axially toward the tailstock die means; in which the support disc means has a hub mounting the disc means on the pilot pin; and in which the disc means hub and pilot pin respectively telescope into the pressure plate means and bushing bores on relative movement between the headstock and tailstock die means toward each other.

13. The construction defined in claim 7 in which the disc means has an annular outer peripheral surface with a diameter complementary to the diameter of the inner cylindrical wall of the tubular blank.

14. The construction defined in claim 7 in which headstock and tailstock face rings are mounted respectively on the headstock and tailstock die means; and in which the annular tapered surfaces are formed on the face rings and cooperate with the spinning roll means for roller spinning the V-groove in the outer blank wall during relative movement between the headstock and tailstock die means.

* * * * *